United States Patent [19]

Kohler et al.

[11] 3,936,549

[45] Feb. 3, 1976

[54] METHOD AND APPARATUS FOR APPLYING A LIQUID COATING TO STRIP MATERIAL

[75] Inventors: John B. Kohler; Ronald R. Brookes, both of North Canton, Ohio

[73] Assignee: The Kohler Coating Machinery Corporation, Greentown, Ohio

[22] Filed: Nov. 17, 1972

[21] Appl. No.: 307,385

[52] U.S. Cl. ..... 427/428; 118/259; 118/262; 427/431

[51] Int. Cl. ..... C23c 1/02; B05c 1/08

[58] Field of Search ..... 118/259, 258, 63, 429, 118/262, 419; 117/114 A, 114 R, 102 A, 102 R, 115

[56] References Cited

UNITED STATES PATENTS

| | | | |
|---|---|---|---|
| 3,032,007 | 5/1962 | McCauliff | 118/259 |
| 3,336,899 | 8/1967 | Mahoney | 118/63 |
| 3,511,693 | 5/1970 | Davidson | 118/259 X |

*Primary Examiner*—Leon D. Rosdol
*Assistant Examiner*—Edith Rollins
*Attorney, Agent, or Firm*—Frease & Bishop

[57] ABSTRACT

Coating apparatus for applying a coating liquid to a moving roll. The apparatus has a trough-like pan, longer than the width of the roll surface to be coated, for holding a supply of the coating liquid. A pair of weirs is mounted on the pan which holds the coating liquid partially impounded therebetween. The weirs are spaced closer than the ends of the roll and the width of the roll surface to be coated. The weirs each are formed with a curved concave central portion having a radius the same or slightly larger than the radius of the roll, and with at least one overflow end portion to serve as a spillway. Coating liquid is supplied continuously to the central portion of the pan between the weirs and is drained continuously from the weir overflow end portions. The level of the coating liquid between the weirs is maintained at a higher level than coating liquid outside the weirs. The roll may serve as a backup roll for a strip passing around it or as a transfer roll to transfer the coating liquid from the pan to a strip in contact with the upper portion of the roll.

A method of applying a coating liquid to one side of a strip of material by providing a body of coating liquid between a pair of spaced weirs which are mounted on a trough-like container. The material to be coated extends laterally beyond the weirs and is passed through the body of coating liquid in a curved path beneath a backup roll which is partially submerged in the coating liquid. The weirs each have a curved portion and at least one end overflow portion communciating with collecting compartments beyond the weirs. The coating liquid level in the collecting compartments is maintained below the lowest level of the curved weir portions whereby the excess coating liquid from the liquid body flows over the weir overflow portions, into the collecting compartments.

12 Claims, 25 Drawing Figures

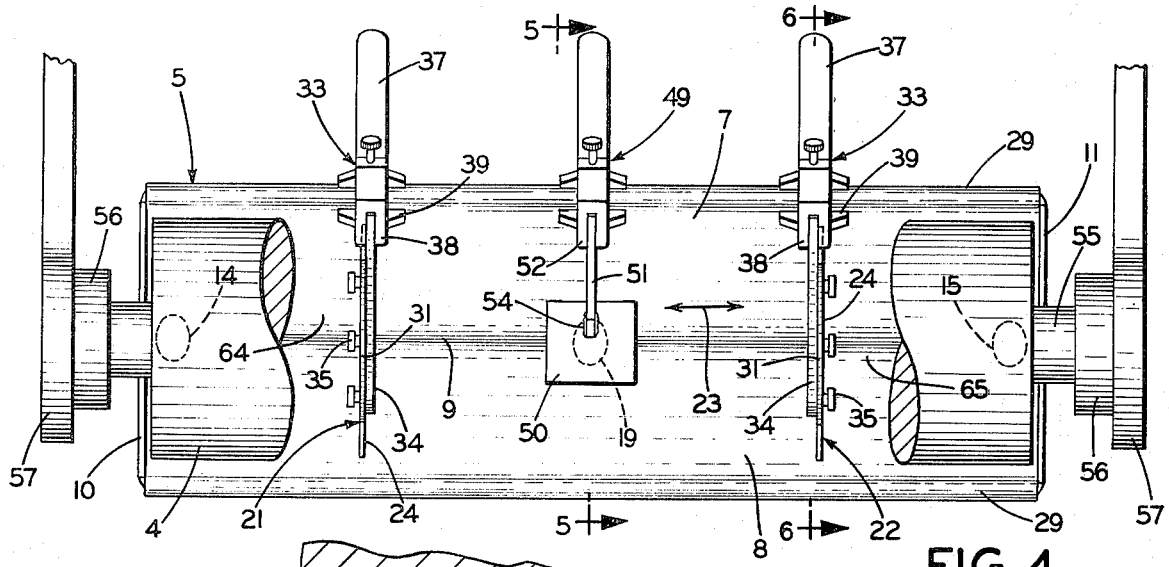
FIG. 4
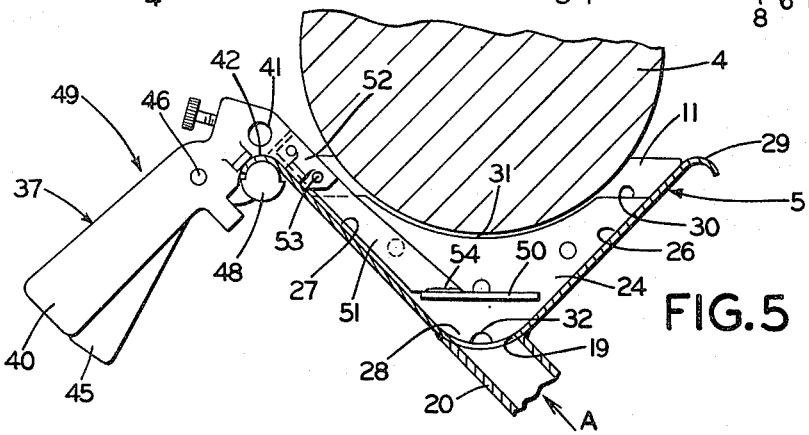
FIG. 5
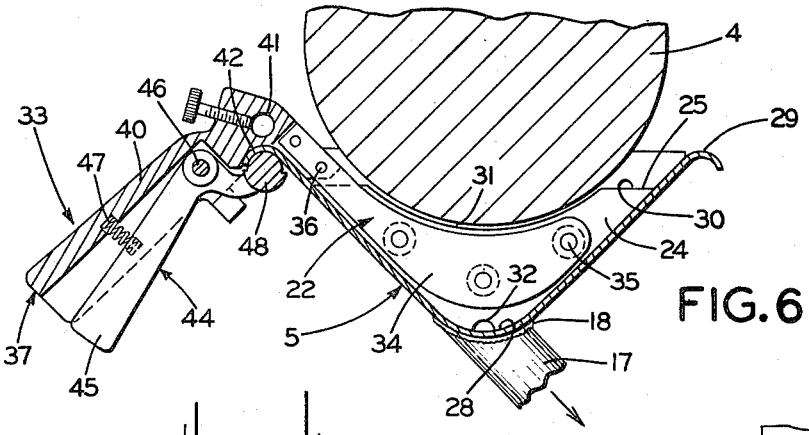
FIG. 6
FIG. 10
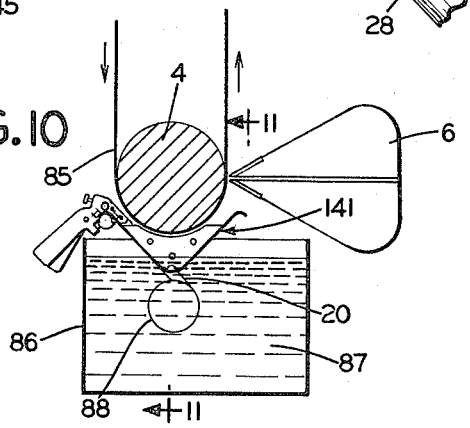
FIG. 9
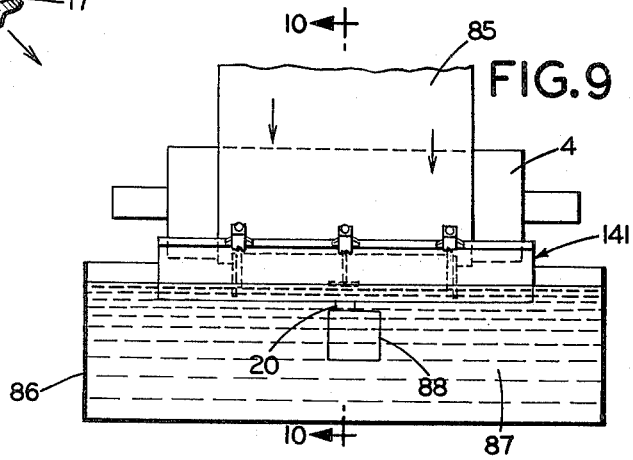

METHOD AND APPARATUS FOR APPLYING A LIQUID COATING TO STRIP MATERIAL

BACKGROUND OF THE INVENTION

1. Field of the Invention

The invention relates to equipment for applying a coating liquid to a moving strip of material, and in particular to a coating pan construction which holds a quantity of coating liquid which is applied directly to one side of the strip or is applied to a transfer roll mounted above the pan and partially submerged in the coating liquid in the pan. More particularly, the invention relates to a coating pan construction having a pair of spaced weirs mounted on the pan which forms a reservoir for a pool of coating liquid which accurately controls the wetted area of the transfer roll or the width of the area to which liquid is applied to the moving strip, and which provides a cleaner pool of coating liquid.

The invention also relates to an improved method of applying a coating liquid to one side of a moving strip of material, and in particular to a method of applying and accurately controlling the moving strip surface area that is coated.

2. Description of the Prior Art

Prior coating equipment and coating methods use pan constructions which hold a supply of coating liquid and in which the strip material backup rolls or the liquid transfer rolls are placed so that the roll journals pass over the pan ends with the body of the roll dipping a short distance into the coating liquid. The rolls dip into the coating liquid a short distance and pick up a quantity of the liquid for transfer to a web or strip of material moving or passing over and in contact with the top of the coating roll. A second roll may be mounted above and in contact with such lower rolls for receiving a supply of coating liquid from the pickup rolls for transfer to a moving strip of material. Likewise, the strip of material may pass directly through the coating liquid moving about and beneath the backup roll partially submerged therein.

It was necessary with such prior coating equipment and in such coating methods to use a coating liquid holding pan of size sufficient to accommodate strips of material of various widths. This resulted in requiring large quantities of coating liquid to completely fill the pan to the proper level even though the width of the strip material being coated was quite small in comparison to the length of the pan. Likewise, even in those situations where a pan roll is used as a backup roll the uncovered portion of the roll is submerged in the coating liquid, requiring frequent and expensive cleanups of the roll and pan.

These prior pans usually had a remote coating liquid supply reservoir to maintain the supply of coating liquid in the pans at the desired level by replacing the liquid that is deposited on the moving strip being coated. Impurities, however, continued to collect within the pan from the surrounding atmosphere and from the strip being coated.

The lighter impurities floating near the top of the coating liquid were transferred to the coated web or strip of material resulting in an uneven coated surface and rough or uncoated areas on the coated strip. The heavier impurities settle to the bottom of the pan, necessitating numerous equipment shutdowns for cleaning the pan, after draining off the coating liquid.

Air bubbles also form on the top of the coating liquid within the pan due to the slight agitation of the liquid by the rotating liquid transfer roll or material backup roll and by the runoff of the excess coating liquid. These bubbles also cause an uneven coating to be applied to the moving strip.

The coating liquid in prior coating equipment and methods works out beyond the roll ends due to the entire roll body being submersed in the coating liquid. This results in the roll ends being "wet" and a supply of coating liquid accumulates thereon. The accumulated coating liquid builds up on the roll journals and mounting mechanism requiring constant maintenance of the same. Likewise, the edges of the strip material being coated also are coated. This is not desirable in many applications since some of the coating material passes to the uncoated side of the strip material.

Thus, a need has existed for coating apparatus and for a method of applying coating liquid to strip material which enable the coating width on the strip or transfer roll to be adjustably and accurately controlled, and which reduce harmful impurities in the coating liquid which heretofore resulted in producing imperfect coatings on the moving strip being coated.

SUMMARY OF THE INVENTION

Objectives of the invention include providing apparatus for applying a coating liquid to strip material which includes a coating liquid holding pan which enables the length of the coating liquid pool to be adjusted within the pan whereby the area of a moving strip to be coated can be adjusted to the desired size, and which requires only a portion of the pan to be filled with coating liquid thereby more effectively using the coating liquid supply; providing apparatus for applying coating liquid to strip material in which the coating liquid is maintained relatively free of harmful impurities which can accumulate during coating operations, by removing the floating impurities through spillways formed along the sides of the pan roll and by removing the heavier impurities through pan bottom openings; providing apparatus for applying coating liquid to strip material having a pair of spaced adjustable weirs mounted on the coating liquid pan for forming a coating liquid pool and pan spillways, in which the pan has drain outlets and an inlet for recirculating the supply of coating liquid, and has deflector means for eliminating harmful agitation of the coating liquid pool by incoming coating liquid supply; and providing apparatus for applying coating liquid to strip material which eliminates difficulties heretofore encountered, achieves the stated objectives simply and effectively, and solves problems and satisfies existing needs.

Objectives of the invention further include providing an improved method for applying coating liquid to moving strip material which enables the coated area of the strip to be accurately controlled and adjusted; which method provides a smoother coated surface on the strip material, freer of blemishes and of unevenly coated spots than with prior procedures; and which method is cleaner, requires less maintenance of the equipment used in carrying out the method, and which eliminates problems heretofore encountered with prior methods of applying coating liquid to a moving strip.

These objectives and advantages are obtained by the liquid coating apparatus, the general nature of which may be stated as including pan means having at least a pair of longitudinally extending side walls and a bottom wall forming an open top container; longitudinally spaced weir means mounted on the pan means and extending laterally between the side walls forming a coating liquid reservoir therebetween together with portions of the side walls and bottom wall within the container; the weir means having top edges, each top edge being formed with a concave curved portion and a liquid overflow portion at least at one end of the curved portion; inlet means communicating with the pan means for supplying coating liquid to the reservoir; drain means communicating with the pan means for removing from the pan means coating liquid which flows from the reservoir over said weir means liquid overflow portions; and means adjustably mounting the weir means on the pan means.

These objectives and advantages of the present invention also are obtained by the new method of applying coating liquid to one side of a moving strip, the general nature of which may be stated as including the steps of providing a container having longitudinally spaced weirs formed with curved portions and a connecting weir overflow portion at least at one end of each curved portion; maintaining a body of coating liquid in said container; passing an object to be coated laterally through the liquid body in a curved path and extending longitudinally beyond the weirs; controlling the spacing of the object being coated from the curved weir edge portions to prevent flow of the coating liquid between the object and the curved weir portions; and flowing excess coating liquid from the body of coating liquid within the container over the weir overflow portions.

BRIEF DESCRIPTION OF THE DRAWINGS

Preferred embodiments of the invention — illustrative of the best modes in which applicants have contemplated applying the principles — are set forth in the following description and shown in the drawings and are particularly and distinctly pointed out and set forth in the appended claims.

FIG. 4 is a reduced fragmentary top plan view, with portions broken away, of the coating roll and improved coating pan construction shown in FIG. 3 with the coating liquid removed;

FIG. 5 is an enlarged fragmentary sectional view taken on line 5—5, FIG. 4;

FIG. 6 is an enlarged fragmentary sectional view taken on line 6—6, FIG. 4;

FIG. 9 is a diagrammatic rear elevation of the improved coating pan construction used in carrying out the improved metal strip coating method;

FIG. 10 is a sectional view taken on line 10—10, FIG. 9;

Similar numerals refer to similar parts throughout the drawings.

DESCRIPTION OF THE PREFERRED EMBODIMENTS

First Embodiment

Figures 1, 2, 3, 7A:
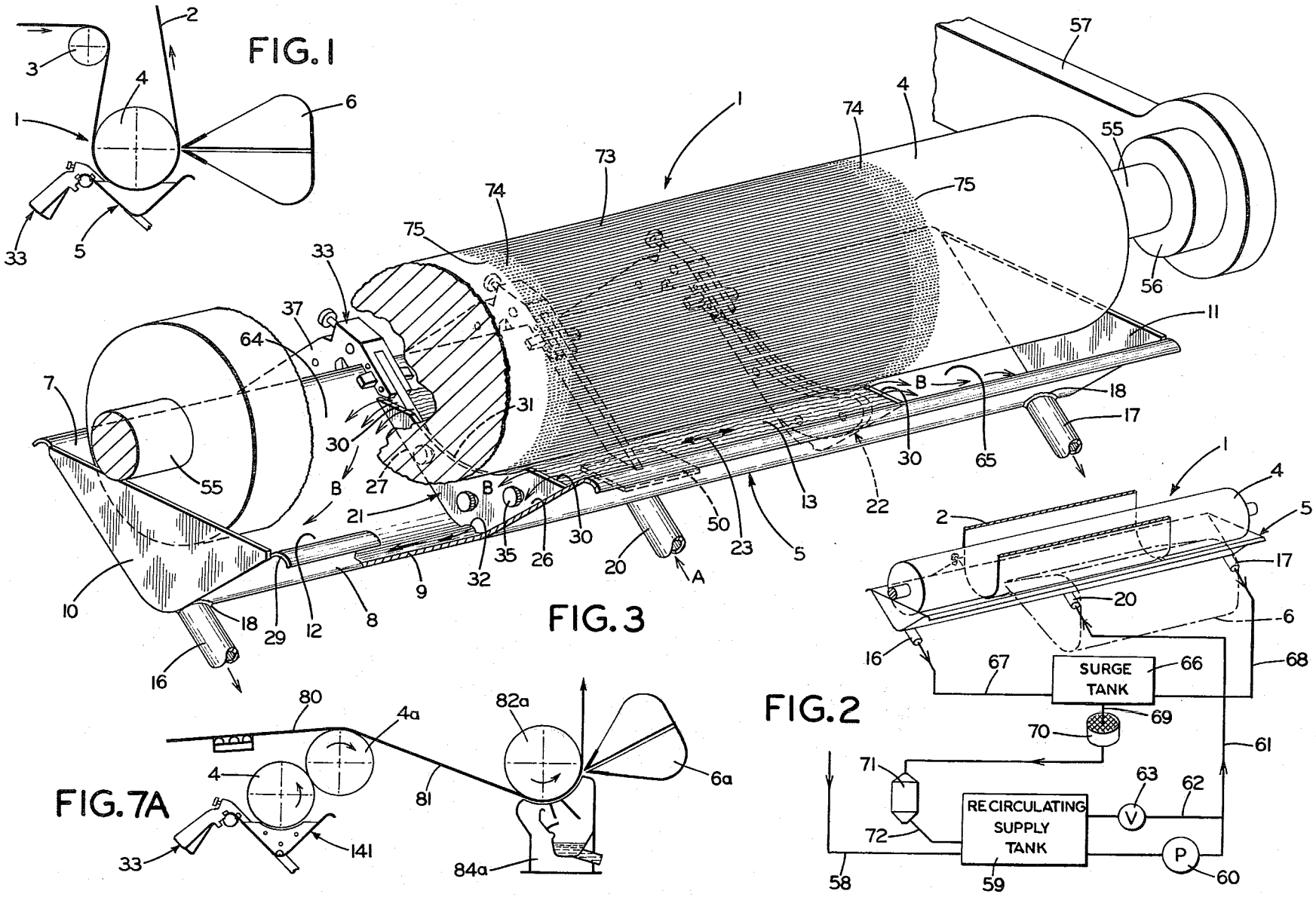
FIG. 1 is a diagrammatic side elevation of the improved coating pan construction used in an improved paper coating method.
FIG. 2 is a more detailed diagrammatic view of a paper coating installation and equipment using the improved coating pan construction.
FIG. 3 is a fragmentary diagrammatic perspective view, with portions broken away and in section, showing a coating roll in cooperation with the improved coating pan construction.
FIG. 7A is a diagrammatic view similar to FIG. 7, showing the improved coating pan construction in association with a pair of transfer rolls, an air knife, and a blowoff box for coating a moving strip.

FIGS. 1 and 3 are diagrammatic views of a coating installation using the improved coating apparatus indicated at 1 and illustrating the improved coating method for coating a paper web 2 on one side with a liquid coating. Web 2 is payed out from a supply roll and moves in a usual manner about a guide roll 3 and beneath a backup roll 4 towards a collection roll or other web treating apparatus (FIG. 1). Roll 4 is mounted above coating apparatus 1 which includes the improved pan construction indicated at 5, which is described in detail below.

Web 2 picks up a supply of coating liquid from within pan 5 and moves upwardly past an air brush 6. Air brush 6 forms a pressure dam on the upward running web 2 to limit the coating film thickness on web 2. The excess coating liquid runs back down web 2 into the pool of coating liquid within pan 5.

The improved coating pan construction 5 used for carrying out the improved coating method, is shown in FIGS. 3–6 in conjunction with a roll 4. Pan 5 preferably is V-shaped in cross section having inwardly sloped longitudinally extending side walls 7 and 8 which join together in a curved bottom wall 9. Spaced laterally extending end walls 10 and 11 extend between the ends of side walls 7 and 8 to form an open trough-like container 12 for holding a supply of coating liquid 13. End walls 10 and 11 are generally V-shaped to coincide with the slope of side walls 7 and 8 and curved bottom wall 9.

Drain openings 14 and 15 (FIG. 4) are formed in bottom wall 9 adjacent end walls 10 and 11, respectively. Drain conduits 16 and 17 are welded at 18 to bottom pan wall 9 and communicate with drain openings 14 and 15.

A coating material inlet opening 19 is formed centrally in bottom wall 9 and communicates with a supply conduit 20 for supplying a quantity of coating liquid 13 to pan 5.

In accordance with the invention, a pair of weirs 21 and 22 is spaced longitudinally within container 12 (FIGS. 3 and 4) for forming a reservoir 23 for holding a supply of coating liquid 13. Weirs 21 and 22 are similar, and each includes a plate 24 having a horizontally laterally extending top edge 25, sloped side edges 26 and 27 and a curved bottom edge 28. Plate side edges 26 and 27 and bottom edge 28 are shaped to follow the contour of pan side walls 7 and 8 and bottom wall 9, to form a generally liquid-tight reservoir 23 with the pan side and bottom walls.

Weir top edges 25 are spaced below the level of top edges 29 of pan side walls 7 and 8 to form spillways 30 between roll 4 and side walls 7 and 8. Excess coating liquid flows unrestricted over spillways 30 into drain compartments 64 and 65 formed by weirs 21 and 22 and pan end walls 10 and 11, respectively. A concavely-shaped central portion 31 is formed in the top edge 25 of each weir 21 and 22. Central portions 31 have a radius of curvature equal to or slightly larger than the radius of the particular roll 4 which is used with pan 5 for a particular coating operation.

A small notch 32 is formed in the bottom edge 28 of each weir to provide openings in weirs 21 and 22 above bottom pan wall 9. Notches 32 permit scale, debris and other impurities, which are heavier than coating liquid 13 and which settle to the bottom of pan 5, to flow through notches 32 for removal from pan 5.

Weirs 21 and 22 preferably are adjustably mounted on pan 5 by a pistol-grip mechanism 33 (FIGS. 3, 4 and 6). Mechanism 33 includes a curved support bracket 34 which is bolted at 35 to weir plate 24 for holding and positioning plate 24 within container 12. The upper end of bracket 34 is bolted at 36 to a handle 37.

Handle 37 has a forked front portion 38 in which bracket 34 is bolted. Forked portion 38 extends downwardly along and in contact with pan wall 7 and has a pair of lugs 39 which extend outwardly from forked portion 38 to provide stability to handle 37 and weir plate 24.

Handle 37 includes a slotted grip 40 formed with an aperture 41 in the top portion thereof. A curved notch 42 is formed at the junction of fork 38 and grip 40 having a radius equal to the radius of the curved upper edge 29 of pan side wall 7. A trigger 44 having an elongated lower lever end 45 is pivotally mounted within slotted grip 40 by a pin 46 and is biased outwardly from grip 40 by a spring 47. A cylindrical lug 48 is formed on the extended upper end of trigger 44 having a radius equal to the inner radius of upper pan edge 29.

Weirs 21 and 22 are mounted easily on pan wall 7 by compressing a trigger 44 within handle grip 40 which pivots lug 48 outwardly and downwardly. Weirs 21 and 22 then are placed within container 12 at the desired location with pan edge 29 engaged within handle notch 42. Trigger 44 is released and lug 48 pivots upwardly into engagement with the bottom side of pan edge 29, clamping handle 37 to pan 5.

Weirs 21 and 22 need not be adjustably mounted on pan 5 by the pistol-grip mechanism 33 as shown and described, but may be mounted by setscrews, clamps or similar attachment means without affecting the operation of weirs 21 and 22.

A pistol-grip mechanism 49 similar to mechanisms 33 also may be used to mount a deflector plate 50 on pan 5 and within container 12 opposite coating liquid inlet opening 19 (FIGS. 3, 4 and 5). A bracket 51 is attached to the forked end 52 of mechanism 49 by bolts 53 and extends downwardly along compartment side wall 7. Plate 50 is welded at 54 to the end of bracket 51 and is spaced a short distance above inlet opening 19.

The incoming stream of coating liquid 13 (arrows A, FIGS. 3 and 5) is deflected by plate 50 upon entering reservoir 23 preventing agitation of the pool of coating liquid 13 and the formation of undesirable air bubbles therein.

Plate 50 preferably is removably mounted on pan 5 by pistol-grip mechanism 49 to permit easy cleaning of pan 5 and plate 50.

Roll 4 is rotatably mounted longitudinally above pan 5 with shafts 55 being journaled in bearings 56. Bearings are attached to the ends of support arms 57 which may be pivotally mounted at their other ends to enable roll 4 to be removed from pan 5 to permit cleaning and maintenance work to be performed on pan 5. Pan 5 also may be mounted on a structure which permits pan 5 to be moved downwardly and away from roll 4, especially where roll 4 is permanently fixed in its mounting mechanism.

A more detailed illustration of the particular paper coating apparatus and method of FIG. 1 is shown in FIG. 2. A supply of coating liquid 13 from a remote source is fed through a line 58 into a recirculating supply tank 59. A pump 60 pumps the coating liquid from tank 59 through line 61 into pan 5 through supply conduit 20 into reservoir 23 where the incoming stream contacts deflector plate 50 and is dispensed into the pool of coating liquid. A bypass line 62 and valve 63 may be connected between tank 59 and line 61 to bypass pump 60.

The incoming stream of coating liquid 13 replaces the liquid applied to the moving web 2 with the excess coating liquid flowing over spillways 30 (arrows B, FIG. 3). This excess liquid flows into drain compartments 64 and 65 and then into conduits 16 and 17 through drain openings 14 and 15.

Conduits 16 and 17 are connected to a surge tank 66 by lines 67 and 68, respectively. The collected coating liquid flows from tank 66 in line 69 through a filtering screen 70 and deaerator 71 to remove impurities from the liquid prior to reentering supply tank 59 through line 72.

The heavier impurities in coating liquid 13 pass from reservoir 23 through weir notches 32 into drain compartments 64 and 65, and then through drain openings 14 and 15 into surge tank 66.

The continuous flow of clean coating liquid 13 into and out of the pool of coating liquid in reservoir 23 between weirs 21 and 22 removes most of the impurities which form and collect within the coating pool. The lighter impurities flow over spillways 30 with the heavier impurities flowing through bottom weir notches 32. The recirculation of the drained coating liquid through filtering screens 70 and deaerator 71 removes the collected impurities, enabling the collected liquid to be returned to the reservoir pool. The liquid entering tank 59 through line 58 from a remote supply is only that needed to make up for the coating liquid applied to web 2.

Roll 4 is spaced above weirs 21 and 22 a sufficient distance to permit roll 4 to rotate freely without contacting top edge 25 of weirs 21 and 22, and close enough to preventing coating liquid 13 from flowing freely therebetween. Most coating liquids have a sufficient thickness and viscosity that a clearance of between 1/32 inch and 1/16 inch is satisfactory to prevent free flowing of the liquid between roll 4 and concave central portion 31 of plate edge 25.

Roll 4 (FIG. 3) is shown wetted with coating liquid 13 only between weirs 21 and 22, as indicated at 73, and in a pair of narrow "workout" strips 74 beyond weirs 21 and 22. Workout strips 74 are the areas covered by coating liquid 13 due to the thinning out of the liquid in a longitudinal or axial direction of the roll onto the uncovered area bordering liquid covered area 73. The width of strips 74 remains relatively constant for a particular coating roll speed and viscosity of coating liquid 13. It has been found that the width of strips 74 remains relatively constant and provides a generally straight outer edge line 75. Thus, roll wipers which heretofore were required to form edge line 75 are no longer essential.

Weirs 21 and 22 can be adjusted to provide for a wetted area 73 on roll 4 having a specific width (FIG. 3), or can be adjusted to provide a specific width of coating on a web 2 (FIGS. 1 and 2) which is passed around roll 4. Coating liquid 13 can be applied only to that area of roll 4 or web 2 which is desired to be coated, without coating the entire roll 4 or web 2 as with prior coating apparatus and methods.

Weirs 21 and 22 enable the ends of roll 4 to run dry which eliminates the buildup of coating liquid on the roll ends which would subsequently dry and harden, portions of which would break off and fall into the bath of coating liquid causing defects in the applied coat. The amount of coating liquid 13 required for a particular coating application is reduced since the coating pond is adjusted to the necessary width, eliminating filling the entire coating pan. The continual recirculation of the coating liquid and removal of the light impurities over spillways 30 and removal of the heavy impurities contained therein through notches 32, provides a highly controlled and accurately applied coated surface on the strip material, more free of defects, such as color lumps and pin holes, than heretofore possible with prior coating apparatus and methods.

A detailed illustration of the improved coating method and of the improved coating apparatus used in carrying out the method is shown in FIGS. 12–16 and is described below. A continuous supply of coating liquid 13 is pumped into pan 5 at a predetermined rate depending upon the particular coating procedure being performed.

The excess liquid 13 flows unrestricted over spillways 30 formed on both sides of roll 4 due to the location of the top edge 25 of weirs 21 and 22 below top edge 29 of pan side walls 7 and 8. This overflow liquid **13*a* and 13*b* (FIG. 12) runs down the outer sides of weir plates 24 into drain compartments 64 and 65 and along bottom pan wall 9 through drain openings 14 and 15**.

Figure 12:
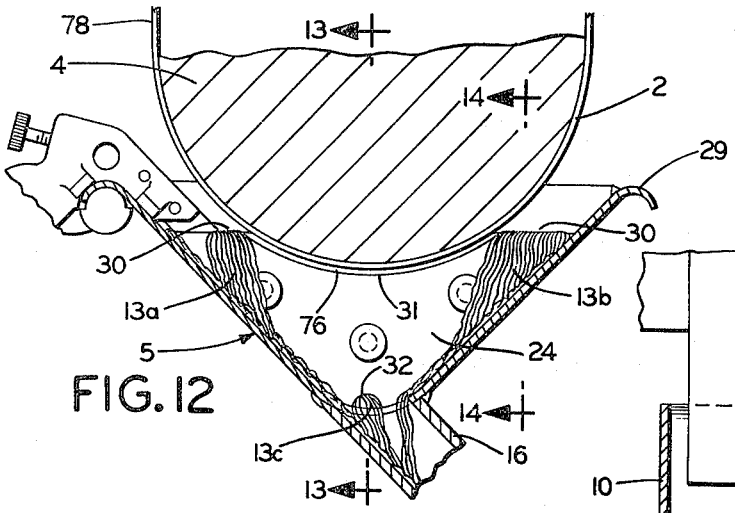
FIG. 12 is a fragmentary sectional view similar to FIG. 5, showing the flow of coating liquid, with the coating roll and strip to be coated in stationary position.
Figure 13:
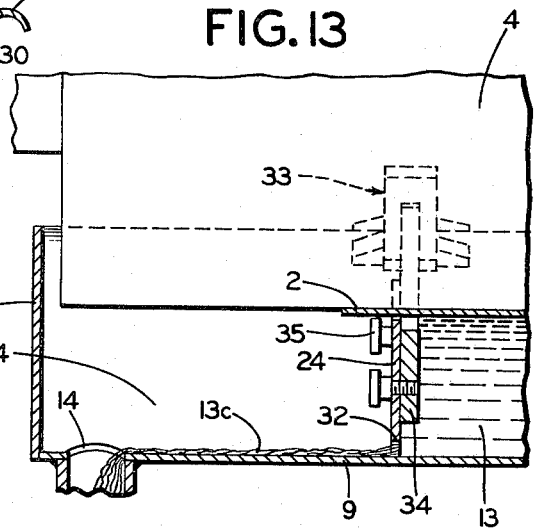
FIG. 13 is a fragmentary sectional view taken on line 13—13, FIG. 12.

Roll 4 is adjusted vertically with respect to concave portions 31 of weir plates 24 so that the arcuate opening or space indicated at 76, between web 2 and portions 31 is small enough to prevent free flow of liquid 13 through opening 76 when roll 4 is stationary but large enough to permit restricted flow when roll 4 is rotating, as shown in FIGS. 12 and 13. The size of opening 76 is determined by the viscosity of liquid 13, the type of material forming web 2 and the speed at which roll 4 will be rotated.

The incoming supply of liquid 13 enters through conduit 20, located at the center of pan 5 and reservoir 23 (FIGS. 3 and 4), and flows in both directions from conduit 20 towards the ends of reservoir 23 carrying with it the light debris floating on top of liquid 13. This light debris is carried over spillways 30 by overflow liquid **13*a* and 13*b* and through drains 16 and 17 to equipment, such as deareator 71 and filters 70, where the impurities are removed before pumping the collected liquid back into reservoir 23**.

Figure 14:
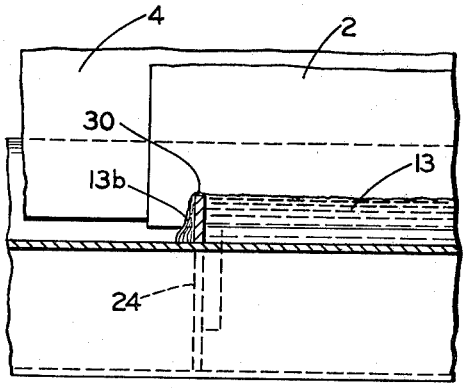
FIG. 14 is a fragmentary sectional view taken on line 14—14, FIG. 12.

The heavier debris and impurities sink to the bottom of reservoir 23 where they are removed by liquid streams **13*c* which flow through weir bottom notches 32 into drains 16 and 17 (FIGS. 12, 13 and 14**).

A small amount of liquid **13*d* moves outwardly along roll 4 through arcuate openings 76 as roll 4 rotates, forming a pair of workout strips 77 adjacent the edges of web 2 (FIG. 16) similar to workout strips 74 on roll 4** (FIG. 3).

The width of workout strips 77 also is determined by the speed of roll 4, the size of openings 76 and the viscosity of the particular coating liquid 13. Even during rotation of roll 4 and the coating of web 2, liquid **13*d* does not flow downwardly along weir plates 24 but moves outwardly along web 2 forming strips 77, as illustrated in FIGS. 15 and 16**.

Figure 15:
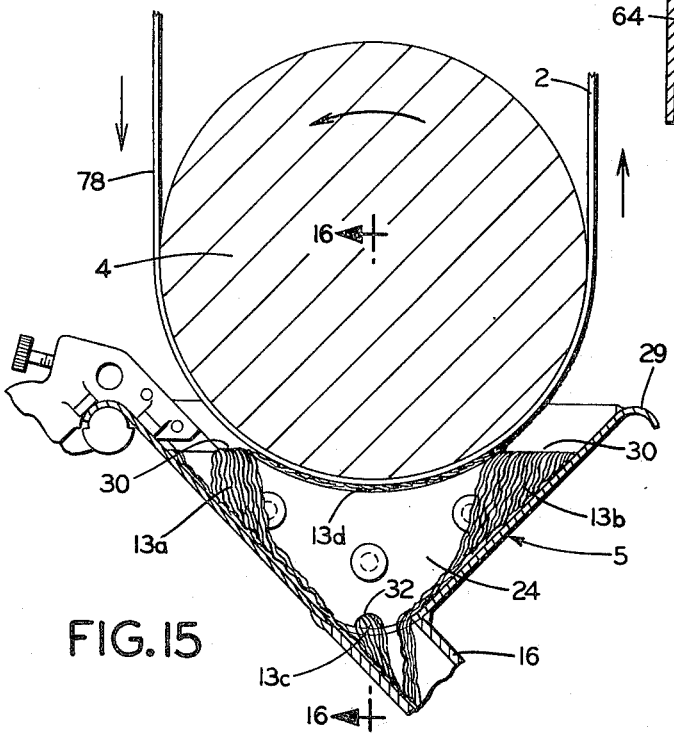
FIG. 15 is a fragmentary sectional view similar to FIG. 12, showing the flow of coating liquid, with the coating roll rotating and the strip passing around the roll.
Figure 16:
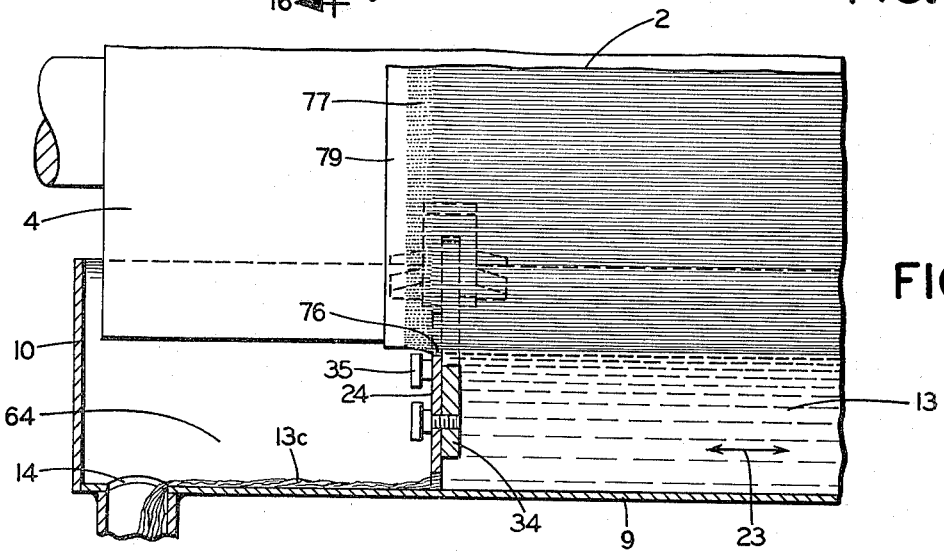
FIG. 16 is a fragmentary sectional view taken on line 16—16, FIG. 15.

Web 2 moves beneath roll 4 in a curved semicircular path and through liquid 13 picking up a quantity of liquid 13 on surface 78 of web 2 (FIGS. 15 and 16). This coating is smoothed and regulated by air brush 6 or other coating control means, such as an air knife or the like.

Edges 79 of web 2 (FIG. 16) may be maintained "dry" by positioning weirs 21 and 22 a sufficient distance inwardly from the web edges so that workout strips 77 do not extend to the edges of web 2. Likewise, the ends of roll 4 are maintained dry and free of coating liquid as well as the remaining central portion of roll 4 covered by web 2. Roll 4 can be maintained completely free from contact with coating liquid 13 by moving web 2 about roll 4 prior to filling reservoir 23 with liquid 13 or prior to moving roll 4 partially into liquid 13, thereby eliminating costly downtime for cleaning roll 4 as heretofore required.

In accordance with the invention, the improved method as shown in FIGS. 12–16, includes the steps of applying a liquid coating 13 to a moving surface 78 of a strip of material 2 by passing surface 78 to web 2 in a curved path through the liquid pool in reservoir 23. Reservoir 23 is maintained in a trough-like container or pan 5 having spaced weirs 21 and 22 which are formed with curved portions 31 connecting weir overflow portions or spillways 30. The openings 76 between web 2 and curved portions 31 are maintained at a predetermined controlled spacing, sufficient to prevent free flow of liquid 13 therebetween when roll 4 is stationary, so that liquid 13 flows from the reservoir beyond either end of the curved weir surfaces over the spaced weir overflow portions and through openings 76 when roll 4 is rotating.

Roll 4 need not be solid as shown in FIGS. 3, 5 and 6, but roll 4 may be hollow enabling a hot or cold medium to be circulated through the roll in a usual manner for heating or cooling, as is well known for example as in U.S. Pat. Nos. 1,961,827, 3,070,457 and 3,279,425.

The heating of the roll outer surface enables a coating liquid applied to roll 4 to be dried and continuously removed as a film of such coating liquid, by a usual process known in the coating trade as "film casting". Likewise, a chilled roll 4 enables a molten coating liquid applied to roll 4 to be solidified and removed as a film in such a film casting process.

Second Embodiment

The improved method and apparatus can be used for coating a strip 80 which passes over the top of roll 4 (FIGS. 7, 7A and 8) instead of passing beneath roll 4 and through liquid 13, as described above and shown in FIGS. 1 and 2. Strip 80 may be a paper web similar to web 2, or may be strips of steel, cloth and the like.

Roll 4 when rotating picks up a quantity of liquid 13 from pan 5 and transfers the liquid to the underside surface 81 and strip 80. Coated strip 80 then passes about a second roll 82 and moves upwardly past an air brush 6 which forms a pressure dam on coated strip 80 to more accurately control the thickness of coating applied thereon. The excess coating liquid 83 runs back down coated surface 81 of strip 80 and drops into a collection tank 84 located beneath roll 82.

Figure 8:
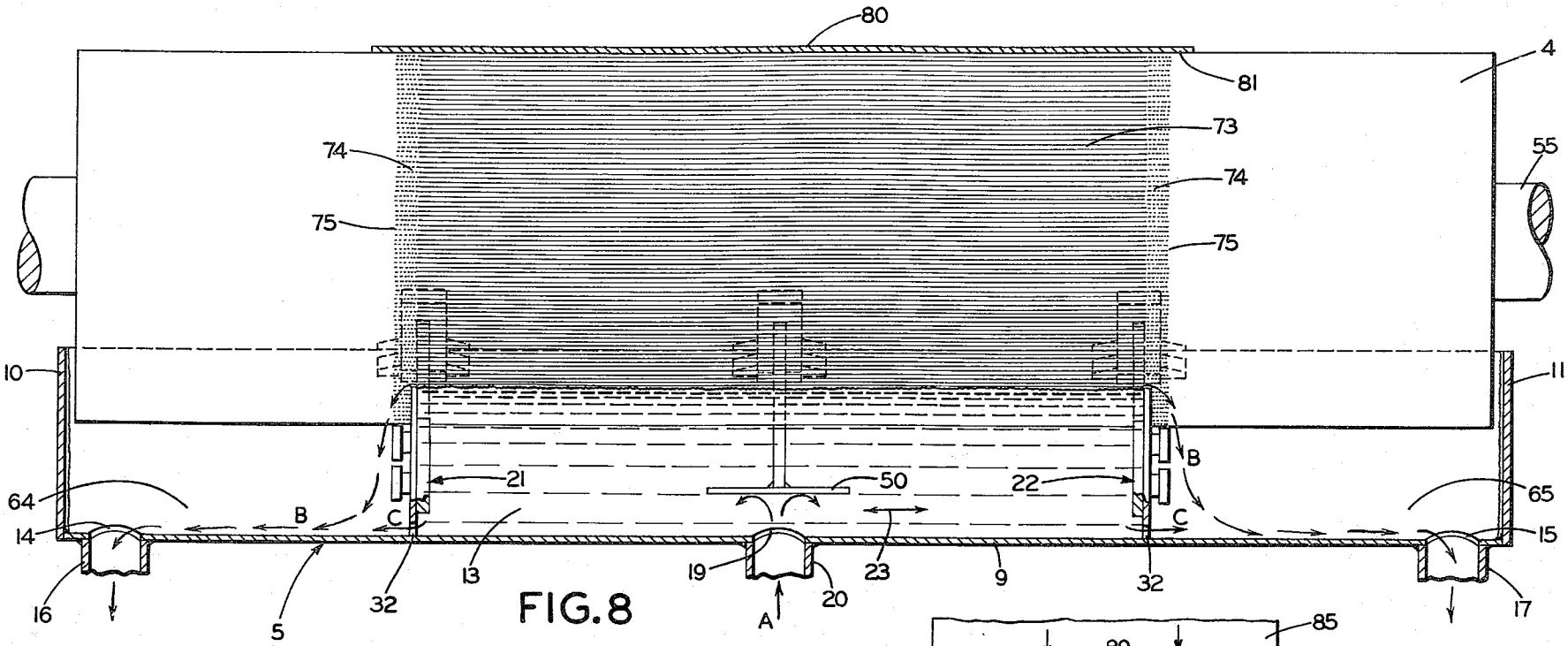
FIG. 8 is an enlarged fragmentary sectional view of the improved coating pan construction for coating moving strip, taken on line 8—8, FIG. 7.

The liquid 13 picked up by roll 4 from pan 5 for transfer to strip 80 assumes the pattern shown in FIG. 8, which is similar to that illustrated in FIG. 3. Area 73 of roll 4 between weirs 21 and 22 is coated with liquid 13 and coated workout strips 74 are formed on both sides of wetted roll area 73.

The entire wetted area of roll 4, consisting of area 73 and strips 74, contacts surface 81 of strip 80 and transfers a portion of liquid 13 to surface 81. Strip 80 preferably has a sufficient width to extend beyond the wetted roll area as shown in FIG. 8, so that the edge portions of strip 80 remain dry. If desired, strip 80 may lie entirely within the wetted area whereby even the edge portions of strip 80 are coated.

Coating liquid 13 flows unrestricted over spillways 30 and weir notches 32 (arrows B and C, FIG. 8), in a similar manner as shown in FIGS. 12–16, to maintain liquid 13 free of many impurities which reduce the quality of the applied coating. Weirs 21 and 22 likewise are adjustable to regulate the width of wetted roll area 73.

Figure 7:
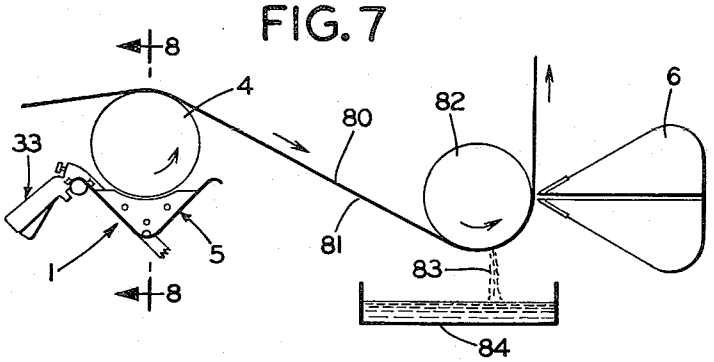
FIG. 7 is a diagrammatic side elevation of the improved coating pan construction and associated equipment used in strip coating installation in which the coating liquid is transferred to the moving strip by a coating roll.

Instead of roll 4 transferring liquid 13 directly to strip 80 as shown in FIGS. 7 and 8, a second roll **4*a* may be mounted adjacent to and in contact with roll 4 (FIG. 7A) for receiving a quantity of liquid 13 from roll 4. The amount of liquid 13 transferred from roll 4 to roll 4*a*** is controlled and regulated by the contacting pressure therebetween.

Strip 80 after having a controlled layer of coating liquid applied to its underside surface 81 from roll **4*a*, passes about a third roll 82*a* mounted above a blowoff box 84*a*. Jets from air knife 6*a* shear the coating liquid and separate the excess from strip 80. This excess coating liquid then is trapped and collected in blowoff box 84*a*** as in U.S. Pat. No. 3,611,987.

Third Embodiment

Figure 11:
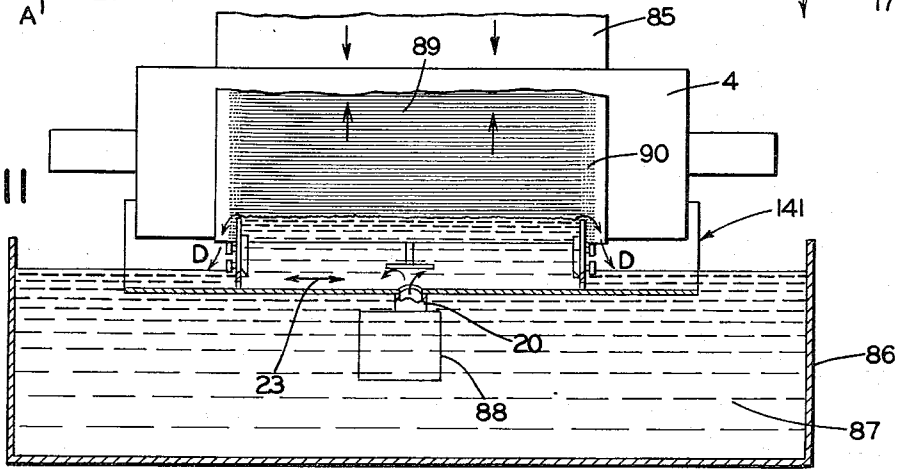
FIG. 11 is an enlarged sectional view taken on line 11—11, FIG. 10.

The improved coating apparatus and method also may be used in the steel industry for the production of coated steel strips 85 (FIGS. 9, 10 and 11), with a galvanized coating on only one side of the strip. A pan 141 similar to pan 5 except for elimination of end walls 10 and 11, and drain conduits 16 and 17, is partially submersed in a pot 86 of molten coating metal, such as zinc 87. Pan 141 and weirs 21 and 22 preferably are made of zinc-resistant material. A submersible pump 88 pumps molten zinc 87 through inlet conduit 20 into reservoir 23 of pan 141. The molten zinc overflows weirs 21 and 22 (arrows D) over spillways 30 and flows directly into molten metal pot 86 for reuse in a manner similar to that described above for the coating of a paper web 2 shown in FIGS. 1 and 3.

Strip 85 moves beneath roll 4 and through the bath of molten zinc 87 within reservoir 23, and then upwardly past air brush 6 or other coating control equipment which smoothes and regulates the thickness of the applied molten zinc 87.

The applied zinc 87 coats the main central portion 89 (FIG. 11) of strip 85 which is defined by the spacing of weirs 21 and 22, with workout strips 90 being formed along both edges of coated portion 89.

Fourth Embodiment

A modified form of the improved coating apparatus which can be used in performing the improved coating method is indicated at 91, and is shown in FIGS. 17–24. Coating apparatus 91 is an improved type of coating equipment, usually referred to as a "puddle" type trailing blade coater.

Prior puddle-type trailing blade coaters consisted of a coating head or trough which contains the coating liquid, and a flexible blade located at the bottom of the through which forms the trough bottom wall. The strip to be coated, usually paper, is drawn around a backup roll, which together with the flexible blade and curved vertical side walls form the trough which holds the coating liquid.

The material upon passing around the roll is coated with the particular coating liquid contained in the trough. This coat is then thinned and smoothed to the desired finish by the trailing blade.

These prior trailing blades are located off-center of the backup roll adjacent the upper quadrant thereof. The blade is slopped downwardly to contact the paper strip which permits the coating liquid to flow freely downwardly along the coated strip when leaks develop between the coating blade and paper strip or backup roll. Difficulties such as spillage of the coating liquid also are encountered when separating the trailing blade trough from the backup roll.

Improved trailing blade coating apparatus 91 (FIGS. 17–19) includes a trough-like pan 92 formed by a sloped rear wall 93, end walls 94 and 95, and a coating blade assembly 96 which forms the pan front wall.

Pan rear wall 93 terminates in a curved upper edge 97 and has a reinforcing channel 98 extending longitudinally along the outer wall surface. A pair of drain openings 99 and 100 is formed in rear wall 93 adjacent end walls 94 and 95, respectively, and a coating fluid inlet opening 101 is formed intermediate drain openings 99 and 100 in rear wall 93. A pair of drain conduits 102 and 103 and an inlet conduit 104 communicate with openings 99, 100 and 101, respectively.

Blade assembly 96 has a longitudinally extending blade holder 105, which together with a flexible doctor coating blade 106 forms the pan front wall. Blade 106 preferably is formed of flexible steel and is retained in blade holder 105 by bolts 107. Blade holder 105 and blade 106 preferably extend the entire distance between end walls 94 and 95.

A mounting beam 108 may be welded at 109 to blade holder 105, which beam is part of a support assembly 110 for supporting coating apparatus 91.

In accordance with the invention, a pair of weirs 111 and 112, generally similar to weirs 21 and 22, are adjustably mounted on pan 92 by pistol-grip mechanisms 113. A fluid deflector plate 114, similar to deflector plate 50, is positioned above fluid inlet opening 101 by a pistol-grip mechanism 115. Pistol-grip mechanisms 113 are similar to pistol-grip mechanisms 33 except for projecting studs 116 which abut rear wall reinforcing channel 98.

Weirs 111 and 112 each includes an irregularly-shaped bracket plate 117 which is bolted at 118 to pistol-grip mechanism 113. Bracket plate 117 has a lower V-shaped portion formed by edges 119 and 120 which coincide with rear pan wall 93 and blade holder 105. Upper edge 121 is horizontal and is spaced below curved top edge 97 of rear wall 93 and below top edges 123 of end walls 94 and 95.

Figure 18:
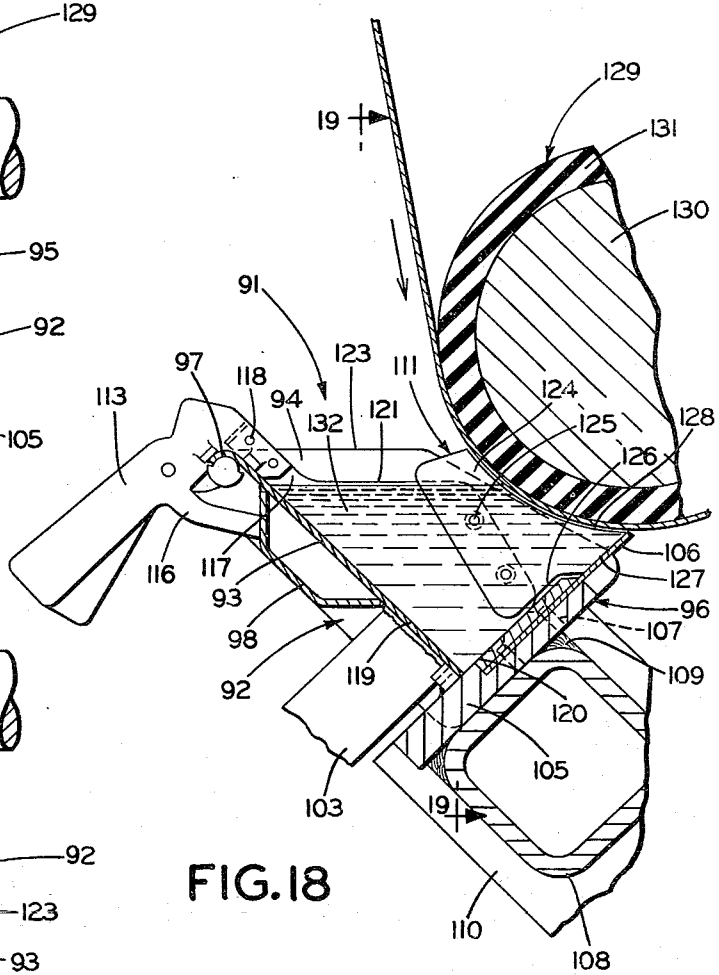
FIG. 18 is an enlarged fragmentary sectional view taken on line 18—18, FIG. 17.
Figure 19:
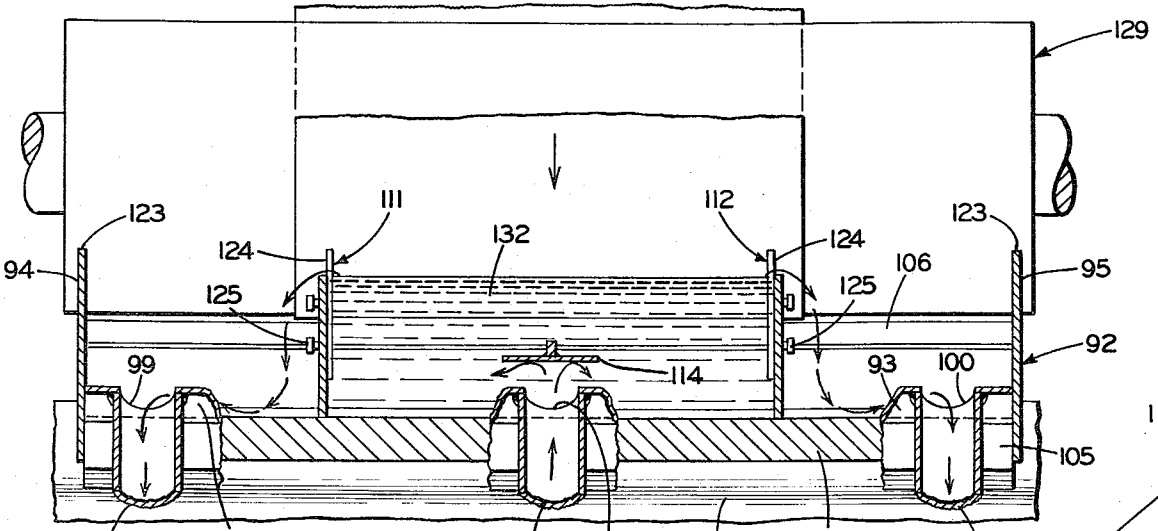
FIG. 19 is a reduced fragmentary sectional view taken on line 19—19, FIG. 18.
Figure 17:
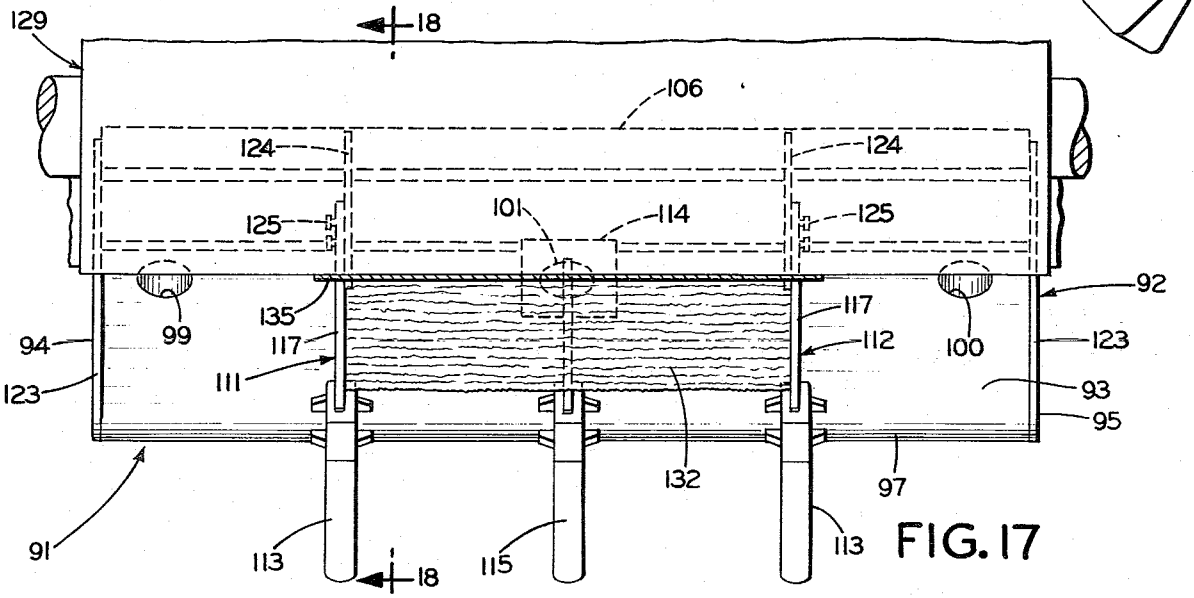
FIG. 17 is a fragmentary top plan view of an alternate construction of the improved coating pan construction.

An end plate 124 is bolted at 125 to the front portion of bracket plate 117, which together with bracket plate 117 forms the weir or partition means extending laterally between pan rear wall 93 and blade holder 105 and blade 106. Plate 124 has flat tapered edge portions 126 and 127 which abut blade holder 105 and blade 106, respectively. The upper forward edge 128 is curved, having a radius of curvature equal to the radius of a backup roll 129 (FIG. 18).

Backup roll 129 is mounted generally above and has its axis longitudinally aligned with pan 92. Roll 129 preferably has an inner steel core or cylinder 130 which is covered by a resilient coating 131, such as rubber or the like.

The manner in which the modified coating apparatus 91 is used in performing the improved coating method is shown in FIGS. 20–24. A pool of coating liquid 132 is formed in pan 92 between weirs 111 and 112 by an incoming flow of liquid through inlet opening 101. The excess liquid **132*a* flows over spillways 133 formed by plate upper edge 121, and then flows through drain openings 99 and 100 removing any impurities on top of liquid 132**.

Figure 20:
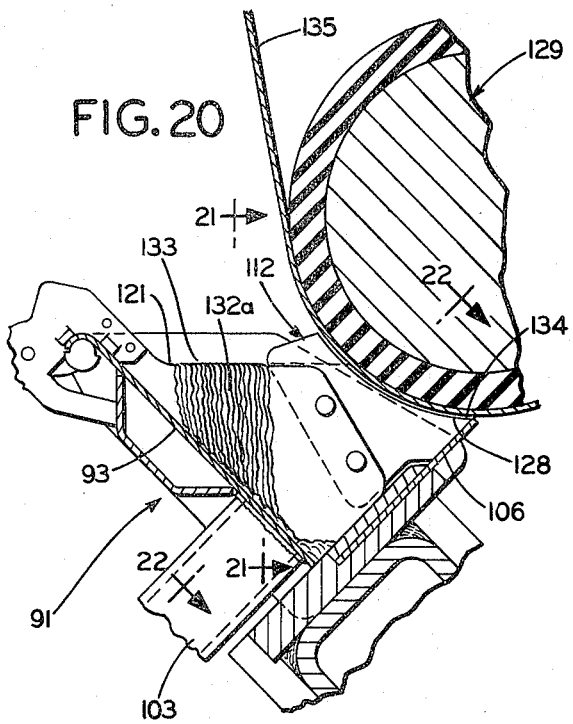
FIG. 20 is a sectional view of an alternate coating pan construction, similar to FIG. 12, showing the coating liquid flow with the coating roll and strip to be coated in stationary position.
Figure 21:
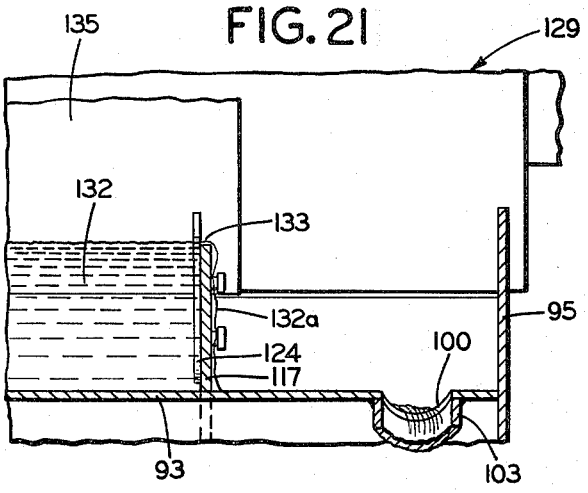
FIG. 21 is a fragmentary sectional view taken on line 21—21, FIG. 20.
Figure 22:
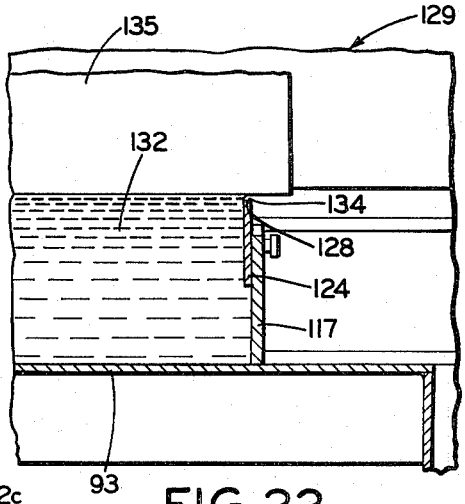
FIG. 22 is a fragmentary sectional view taken on line 22—22, FIG. 20.

Roll 129 is adjusted with respect to curved upper edge 128 of each end plate 124 so that the arcuate opening 134 between a strip of material 135 to be coated and edge 128 is small enough to prevent free flow of liquid 132 through opening 134 when roll 129 is stationary, as shown in FIGS. 20–22. As discussed previously in regards to roll 4 and arcuate opening 76 (FIG. 12), the size of opening 134 is determined by the viscosity of liquid 132, strip 135, and the rotational speed of roll 129.

A quantity of liquid **132*b* is picked up by strip 135 (FIG. 23) as it moves in a curved path through liquid pool 132. Liquid 132*b* is reduced to a smooth coat of liquid 132*c* upon passing blade 106. A small quantity of liquid 132 moves outwardly through openings 134 forming workout strips 136 on both ends of the main coated portion 137 (FIG. 24**).

Thus, a liquid coat is applied to one side of a moving strip without backup roll 129 becoming wet and without the roll ends accumulating a buildup of coating liquid. Likewise, the coating liquid is maintained free of most impurities by continuously removing a portion of the liquid over the weir plate top edge overflow portions, which liquid may then be cleaned and pumped back into the coating liquid pool.

Figure 23:
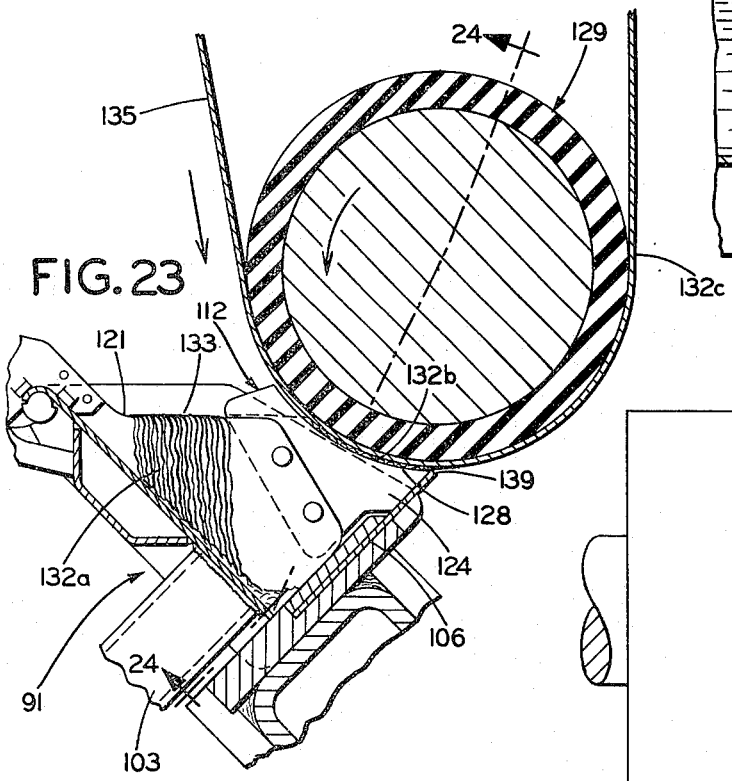
FIG. 23 is a fragmentary sectional view similar to FIG. 20, showing the coating liquid flow with the coating roll rotating and the strip passing around the roll.
Figure 24:
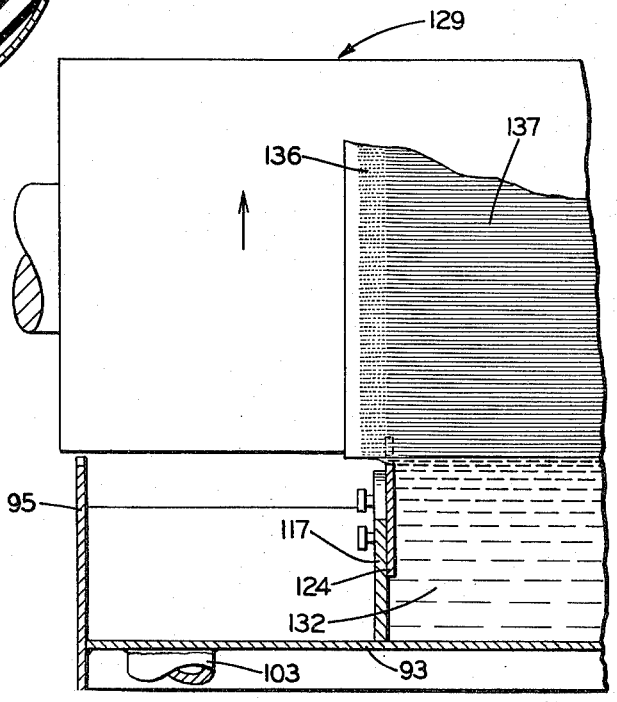
FIG. 24 is a fragmentary sectional view taken on line 24—24, FIG. 23.

Modified coating apparatus 91 has the additional advantage of being in the lower quadrant on the downrunning side of strip 135, as shown in FIGS. 18, 20 and 23. Thus, blade 106 extends in an upwardly sloped direction in relation to roll 129, rather than in a downwardly sloped direction as is prior trailing blade coaters in which the pool of coating liquid is located in the upper quadrant.

This upward engagement of blade 106 with roll 129 greatly reduces the leakage of coating liquid between blade tip 139 and roll 129. Likewise, the small amount of coating liquid which works out through openings 134 to form workout strips 136 also is smoothed by blade 106 with the excess running downwardly along the inner blade and blade holder surfaces into pan 92.

IN GENERAL

In each of the mechanisms and methods of the invention illustrated in the drawings and described above, trough-like pan means is provided with a pair of spaced weirs to form a pool of coating liquid which can be continuously recirculated to remove impurities that cause blemishes in the coated surface. The weirs enable method steps to be carried out of the coating a predetermined portion of the surface of a moving strip, while passing the strip through a bath of coating liquid, and of simultaneously flowing coating liquid unrestricted over portions of the weirs.

The strip when being coated and in moving along its line of travel thus enters and passes through a bath of coating liquid which extends laterally of the line of strip travel; coating liquid in the bath flows laterally of the bath and of the strip with respect to the line of strip travel; the laterally flowing coating liquid is confined against lateral flow across the moving strip beyond a predetermined zone; and the laterally flowing coating liquid in the bath overflows laterally from the bath in zones at each edge of the strip at least spaced rearwardly of the direction of strip travel at the location of the initial entry of the strip into the coating liquid bath.

The term coating liquid as used throughout the above description includes numerous types of usual liquids which are applied to various materials. Such coating liquids may include materials used to coat paper, or hot metal for coating steel, or dyes which soak into paper, cloth, etc. instead of forming an exterior layer, coating or film on the material as do many of the other conventional coating liquids. The applied films also may be permanently bonded to the material or may be peeled off as a continuous film in a cast coating method.

Also, the spacing between the roll or strip and the concave central weir portion may be greater or less than that spacing described above which prevents free flow of the coating liquid therethrough, without departing from the concept of the invention. Should the spacing be large enough to permit the free flow of coating liquid, the pumping rate of supplying coating liquid to reservoir 23 merely would be increased to maintain the proper level of coating liquid in reservoir 23. Also, too small of spacing may cause contact between roll 4 and the concave weir portion resulting in wear on the roll or weir or friction therebetween.

Accordingly, the improved apparatus and method for coating a strip provides for continually recirculating the coating liquid to remove impurities occurring in the pool of cooling liquid; enables the size of the pool of coating liquid to be adjusted whereby only that portion of the coating pan necessary to coat a predetermined portion of the strip need by filled with coating liquid; provides for maintaining the coating roll ends free for coating liquid during coating operations thereby reducing equipment downtime for maintenance and cleanup; enables maximum efficiency to be achieved in applying a coating of liquid to a strip; and provides improved coating apparatus and methods which are effective, safe, relatively inexpensive, and efficient in assembly, operation and use, and which achieves all the enumerated objectives, provides for eliminating difficulties encountered with prior devices and methods, and solves problems and obtains new results in the art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the operations and procedure of the preferred method, the manner in which the improved strip material coating apparatus used for performing the method is constructed, assembled and operated, the characteristics of the new method and apparatus, and the advantageous, new and useful results obtained; the new and useful methods, steps, operations, procedures, structures, devices, elements, arrangements, parts, and combinations are set forth in the appended claims.

We claim:

1. The method of applying a coating liquid to a surface of a moving object including the steps of providing an elongated coating liquid container having spaced weirs each formed with an upper curved portion; continually supplying coating liquid to said liquid container in excess so that a body of coating liquid is maintained in the container between the weirs; moving an object to be coated in a direction normal to the elongated container through the liquid body therein in a curved path with the object extending laterally of the liquid body in each direction beyond the weirs; providing a spacing between the curved weir portions and the object being coated; flowing coating liquid outwardly beyond the weirs laterally of the object being coated through the controlled spacings; controlling the spacing between the object being coated and the curved weir portions to prevent contact between the weir portions and the moving object being coated, and to control the flow of liquid between the moving object and the curved weir portions; providing coating liquid eollecting compartments outside of the weirs; collecting coating liquid flowing through the controlled spacings beyond the curved weir portions and the moving object in said collection compartments; and maintaining the liquid level in the collecting compartments below the lowest level of the curved weir portions.

2. The method defined in claim 1 in which the supplied coating liquid is deflected upon entering the liquid body to minimize agitation of the coating liquid body.

3. The method defined in claim 1 in which the amount of coating liquid spreading outwardly beyond the weirs on the object being coated is controlled by predetermined correlation of the viscosity of the coating liquid, the speed of movement of the object being coated, and the spacing between the curved weir portions and the object being coated.

4. The method defined in claim 1 in which the coating liquid is pumped back into the coating liquid body from the collecting compartments.

5. The method of applying a coating liquid to a surface of a moving object including the steps of providing an elongated coating liquid container having spaced weirs each formed with an upper curved portion and a connecting weir overflow portion; continually supplying coating liquid to said liquid container in excess so that a body of coating liquid is maintained in the container between the weirs; moving an object to be coated in a direction normal to the elongated container through the liquid body therein in a curved path with the object extending laterally of the liquid body in each direction beyond the weirs; providing a spacing between the curved weir portions and the object being coated; flowing coating liquid outwardly beyond the weirs laterally of the object being coated through the controlled spacings; controlling the spacing between the object being coated and the curved weir portions to prevent contact between the weir portions and the moving object being coated, and to control the flow of liquid between the moving object and the curved weir portions; flowing coating liquid unrestricted from the liquid body over the weir overflow portions; providing coating liquid collecting compartments outside of the weirs; collecting coating liquid flowing over the weir overflow portions and through the controlled spacings beyond the curved weir portions and the moving object in said collection compartments; and maintaining the liquid level in the collecting compartments below the lowest level of the curved weir portions.

6. The method defined in claim 5 in which weir overflow portions are provided at both ends of the curved weir portions; in which coating liquid is flowed from the liquid body over both weir overflow portions at either side of the moving object to purge the liquid body of floating trash.

7. The method defined in claim 1 in which the coating liquid applied to the moving object as it emerges from the liquid body is subjected to smoothing and metering pressure.

8. The method defined in claim 1 of coating one side of a strip in which the moving object comprises a roll rotatably mounted above the container onto which the coating liquid is applied; and in which a strip is moved in unison along the upper portion of the roll to transfer coating liquid from the roll to one side of the strip.

9. The method defined in claim 1 in which a rotatable backing roll is supported above the elongated container; and in which a strip is passed around the backing roll and through the liquid body to coat one side of the strip with coating liquid.

10. The method defined in claim 5 in which the moving object being coated is a continuously moving metal strip; in which a bath of molten metal is maintained to provide the coating liquid body; and which includes the further steps of maintaining the elongated coating liquid container partially submerged in the bath of molten metal; pumping the molten metal from the bath into the container between the weirs thereby maintaining the level of the body of molten metal between the weirs above the level of the bath of molten metal; and flowing the molten metal over the weir overflow portions directly into the bath of molten metal.

11. The method defined in claim 5 in which the supplied coating liquid is deflected upon entering the liquid body to minimize agitation of the coating liquid body.

12. The method defined in claim 5 in which drain openings are formed in the bottom of the weirs; and in which coating liquid is flowed from the liquid body through said drain openings to purge the liquid body of impurities heavier than the coating liquid.

* * * * *